US007726791B2

(12) United States Patent
Komplin

(10) Patent No.: US 7,726,791 B2
(45) Date of Patent: Jun. 1, 2010

(54) CONDUIT CONSTRUCTION USING FILMS

(75) Inventor: Steven Robert Komplin, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 992 days.

(21) Appl. No.: 11/394,955

(22) Filed: Mar. 31, 2006

(65) Prior Publication Data

US 2007/0229630 A1 Oct. 4, 2007

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 4,677,448 A * 6/1987 Mizusawa et al. ..... 347/85
5,742,312 A 4/1998 Carlotta
5,953,030 A * 9/1999 Ishinaga et al. ..... 347/86
6,766,817 B2 7/2004 da Silva
7,285,255 B2 10/2007 Kadlec et al.
2005/0156988 A1 7/2005 Silverbrook et al.
2008/0015531 A1 1/2008 Hird et al.

OTHER PUBLICATIONS

Silva, Elson, E-mail communication regarding Hydrology, Jun. 8, 2008 (with drawings).

* cited by examiner

*Primary Examiner*—Anh T. N. Vo

(57) ABSTRACT

A method of forming a conduit providing fluid communication between respective reservoirs of an ink tank, the method comprising the steps of: (a) forming a first orifice extending through a first external wall portion of an ink tank defining part of a first ink reservoir of the ink tank; (b) forming a second orifice extending through a second external wall portion of the ink tank defining part of a second ink reservoir of the ink tank; and (c) attaching a substrate over the first and second external wall portions at least about a first continuous seal line surrounding both the first and second orifices to define an external conduit communicatively connecting the first ink reservoir with the second ink reservoir.

3 Claims, 5 Drawing Sheets

CONDUIT CONSTRUCTION USING FILMS

FIELD OF THE INVENTION

The present invention concerns reservoirs for storing liquid contents and, more specifically, to reservoirs utilized to store liquid ink for inkjet printer applications.

BACKGROUND AND SUMMARY

The present invention concerns containers utilized to house liquids and, more specifically, to containers utilized to house liquid ink for inkjet printer applications. Ink containers may be integral with a printhead or communicatively connected thereto. In applications where replacement ink containers are communicatively connected to a permanent printhead, it is desirable that the container be able to supply ink in a predictable manner. Exemplary replacement ink containers may includes one or more chambers filled or partially occupied by liquid ink. To impart a predictable flow of ink from the container to the printhead, the container may house one or more backpressure mediums. Backpressure mediums are mediums that include pores through which liquids can flow, but that provide a resistance to flow resulting from capillary action. Typical backpressure mediums include felts, foams, and other fibrous mediums having pores sizes imparting predictable resistance to fluid flow from the resulting capillarity.

In order to increase the utilization of ink within a container, it is usually preferred that the backpressure medium occupy as little space as possible to satisfy the breathing requirements of the container. At the same time, less backpressure medium results in less control over the flow of ink from the container. In other words, a balance is generally arrived at that involves providing one chamber of the container having a backpressure medium (backpressure chamber) that is in communication with another chamber of the container housing only liquid ink or a combination of liquid ink and trapped gases (free ink chamber).

Conventional ink containers provide for transfer of liquid ink between free ink chambers and backpressure chambers using one or more openings through internal walls of the container that would otherwise separate the chambers. Typically, one or more internal walls step as a partition, but for an opening through the lower level of the wall to allow ink to travel from the free ink chamber and into the backpressure chamber only when the level of ink within the backpressure chamber drops below a predetermined point. This predetermined point typically coincides with the level of the opening between the chambers so that air bubbles from the backpressure chamber can flow into the free ink chamber to displace liquid ink, thereby driving liquid ink into the backpressure chamber until the level of ink within the backpressure chamber rises and cuts off the opening, discontinuing gaseous transfer into the free ink chamber and liquid ink transfer into the backpressure chamber.

Some embodiments of the instant invention provide an alternative to the internal wall openings and provides conduits that extend outside of the conventional ink container by utilizing a substrate mounted to the exteriors of the chambers that allow communication between the free ink chamber and the backpressure chamber, with or without requiring molding of openings within internal walls. Some embodiments also provide manufacturing alternatives that allow the formation of openings within the internal wall separating the chambers without requiring tooling to be substantially constrained by the dimensions of the ink container.

Some embodiments of the present invention to provide a method of forming a conduit providing fluid communication between respective reservoirs of an ink tank, that include the steps of: (a) forming a first orifice extending through a first external wall portion of an ink tank defining part of a first ink reservoir of the ink tank; (b) forming a second orifice extending through a second external wall portion of the ink tank defining part of a second ink reservoir of the ink tank; and (c) attaching a substrate over the first and second external wall portions at least about a first continuous seal line surrounding both the first and second orifices to define an external conduit communicatively connecting the first ink reservoir with the second ink reservoir.

In an embodiment, the method further includes the step of providing at least one depression in the first and second external wall portions extending between the first and second conduits. In another embodiment, the method further includes the steps of (i) forming a third orifice extending through a third external wall portion of the ink tank defining part of the first ink reservoir; (ii) forming a fourth orifice extending through a fourth external wall portion of the ink tank defining part of the second ink reservoir; and (iii) attaching a second substrate over the third and fourth external wall portions at least about a second continuous seal line surrounding both the third and fourth orifices to define a second external conduit communicatively connecting the first ink reservoir with the second ink reservoir. In a further embodiment, the first orifice is adjacent to a first felt member occupying at least a portion of an internal area of the first ink reservoir, and the second orifice is in direct communication with free ink occupying at least a portion of an internal area of the second ink reservoir.

In yet another embodiment, the first and second substrates include a single substrate and the single substrate comprises the first and second seal lines. In still another more detailed embodiment, the first orifice and the second orifice of the first ink reservoir are adjacent to a first felt member occupying at least a portion of an internal area of the first ink reservoir, the first orifice and the second orifice of the second ink reservoir are in direct communication with free ink occupying at least a portion of an internal area of the second ink reservoir, and the combination of the first conduit and the second conduit provides the exclusive manner for fluids to traverse between the first reservoir and the second reservoir. In a further embodiment, the substrate comprises a polymer film, and the first portion of the film is laminated to an exterior wall of the first ink reservoir and to an exterior wall of the second ink reservoir. In still a further detailed embodiment, the step of laminating the first portion of the substrate to the first ink reservoir and to the second ink reservoir includes at least one of heat staking, laser welding, ultrasonic welding, vibrational welding, and adhesive mounting a film to an exterior wall of the first ink reservoir and to an exterior wall of the second ink reservoir.

Some embodiments described herein include a method of forming a conduit providing fluid communication between respective reservoirs of an ink tank, the method comprising the steps of: (a) forming a first orifice through a wall of an ink tank and into communication with a first reservoir and a second reservoir of the ink tank; and (b) sealing a substrate to the ink tank to overlap the first orifice and form a first by-pass conduit communicatively connecting the first reservoir and the second reservoir.

In a more detailed embodiment, the method further includes the steps of: (i) forming a second orifice through the wall of the ink tank and into communication with the first reservoir and the second reservoir of the ink tank; and (ii)

sealing the substrate to the ink tank to overlap the second orifice and form a second by-pass conduit communicatively connecting the first reservoir and the second reservoir. In yet another more detailed embodiment, the first reservoir comprises a free ink reservoir, and the second reservoir comprises a backpressure reservoir that is occupied by a backpressure media. In a further detailed embodiment, the combination of the first conduit and the second conduit provides the exclusive manner for fluids to traverse between the first reservoir and the second reservoirs and the substrate comprises a polymer film.

Some embodiments of the present invention provide an ink tank comprising: (a) a first reservoir for housing a liquid ink, the first reservoir including a first orifice through a wall at least partially defining an interior region of the first reservoir; (b) a second ink reservoir for housing a liquid ink, the second ink reservoir including a first orifice through a wall at least partially defining an interior region of the second reservoir; and (c) a first conduit overlapping the first orifice of the first ink reservoir and the first orifice of the second ink reservoir allowing fluid communication between the first reservoir and the second reservoir, the first conduit defined at least in part by a film mounted to the wall of the first ink reservoir and to the wall of the second ink reservoir.

In a more detailed embodiment, the first reservoir comprises a backpressure chamber housing at least one backpressure medium through which liquid ink traverses prior to exiting through an ink outlet orifice of the backpressure chamber, and the second reservoir comprises a free ink chamber housing liquid ink prior to entering the backpressure chamber. In yet another more detailed embodiment, the free ink chamber and the backpressure chamber share a common wall, and the common wall includes an opening therethrough providing a second conduit between the free ink chamber and the backpressure chamber. In a further detailed embodiment, at least one of the wall of the first reservoir and the wall of the second reservoir includes a furrow extending lengthwise in parallel with a line of travel between the first orifices. In still a further detailed embodiment, the ink tank further comprises: (i) a second orifice through the wall at least partially defining the interior region of the first reservoir; (ii) a second orifice through the wall at least partially defining the interior region of the second reservoir; and (iii) a second conduit overlapping the second orifice of the first ink reservoir and the second orifice of the second ink reservoir to allow fluid communication between the second orifices, the second conduit defined at least in part by a film mounted to the wall of the first ink reservoir and to the wall of the second ink reservoir.

Some embodiments of the present invention provide an ink tank comprising: (a) a first vessel defining a first ink reservoir; (b) a second vessel defining a second ink reservoir; and (c) a first by-pass conduit communicatively connecting the first vessel to the second vessel by way of a first orifice that concurrently exposes the first vessel and the second vessel, the first by-pass conduit comprising a first substrate overlapping the first orifice and enclosing one side of the first orifice to allow sealed fluid communication between the first vessel and the second vessel.

In a more detailed embodiment, the first reservoir comprises a free ink reservoir for supplying liquid ink to the second reservoir, and the second reservoir comprises a backpressure reservoir housing at least one backpressure medium through which liquid ink traverses prior to exiting through an ink outlet orifice of the second vessel. In yet another more detailed embodiment, the first vessel and the second vessel share a common wall that includes an opening therethrough directly linking the first reservoir to the second reservoir. In a further detailed embodiment, the ink tank further comprises a second by-pass conduit communicatively connecting the first vessel to the second vessel by way of a second orifice that concurrently exposes the first vessel and the second vessel. In still a further detailed embodiment, the second by-pass conduit comprises a separate substrate overlapping the second orifice and enclosing one side of the second orifice to allow sealed fluid communication between the first vessel and the second vessel. In a more detailed embodiment, the ink tank further comprises a second by-pass conduit communicatively connecting the first vessel to the second vessel by way of corresponding orifices that expose the first vessel and the second vessel, the second by-pass conduit comprising a second substrate overlapping the corresponding orifices and enclosing a side of the corresponding orifices to allow sealed fluid communication between the first vessel and the second vessel. In a more detailed embodiment, the first substrate and the second substrate comprise a polymer film.

Some embodiments of the present invention provide a method of facilitating fluid communication between chambers of an ink tank, the method comprising the steps of: (a) forming a hole through an exterior wall bounding a first chamber of an ink tank; (b) forming a hole through an exterior wall bounding a second chamber of an ink tank; and (c) sealing a film to the exterior wall of the first chamber and to the exterior wall of the second chamber to encompass the hole of the first chamber and the hole of the second chamber to create an external sealed conduit providing fluid communication between the first chamber and the second chamber.

Some embodiments of the present invention provide a method of establishing countercurrent fluid transfer between areas of an ink tank, the method comprising the step of sealing a film to an exterior surface of an ink tank to define a first sealed exterior passage between at least two compartments of the ink tank, the seal between the film and the exterior surface of the ink tank outlining at least a first opening through the ink tank.

In a more detailed embodiment, the method further comprises the step of sealing a second film to the exterior surface of the ink tank to define a second sealed exterior passage between at least two compartments of the ink tank, the seal between the film and the exterior surface of the ink tank outlining at least a second opening through the ink tank. In yet another more detailed embodiment, the step of sealing the second film to the exterior surface of the ink tank seals the second sealed exterior passage to the exclusion of the first sealed exterior passage. In a further detailed embodiment, the ink tank includes an interior passage through an interior wall of the ink tank providing fluid communication between the first chamber and the second chamber of the ink tank, where the interior passage allows fluid to flow in a first direction from the first chamber to the second chamber, and the first sealed exterior passage allows fluid to flow in a second direction, opposite that of the first direction.

Some embodiments of the present invention provide a method of forming an ink tank, the method comprising: (a) molding at least two ink chambers of an ink tank, each ink chamber is defined by vertical walls that intersect a horizontal wall, where the at least two chambers share a common wall dividing the chambers from one another; (b) forming a first orifice and a second orifice through the horizontal floor, where the second orifice is vertically overlapped by the common wall; (c) mounting a lid to the vertical walls opposite the horizontal wall; and (d) mounting a film over the first orifice and the second orifice to inhibit fluid from egressing through the orifices.

In a more detailed embodiment, the common wall includes an opening therethrough providing fluid communication between the at least two chambers, and the step of forming the second orifice through the horizontal wall includes removing material from the horizontal wall to create the second orifice and further includes removing material from the common wall directly above the second orifice to form the opening through the common wall. In a further detailed embodiment, further comprising the step of: (i) forming a first orifice through a vertical wall defining the first chamber; (ii) forming a first orifice through a vertical wall defining the second chamber; and (iii) mounting a film to the vertical wall of the first chamber and to the vertical wall of the second chamber to encompass the first orifices and provide a sealed conduit between the first chamber and the second chamber.

DETAILED DESCRIPTION

The exemplary embodiments of the present invention are described and illustrated below to encompass reservoirs for storing fluid contents. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 1:
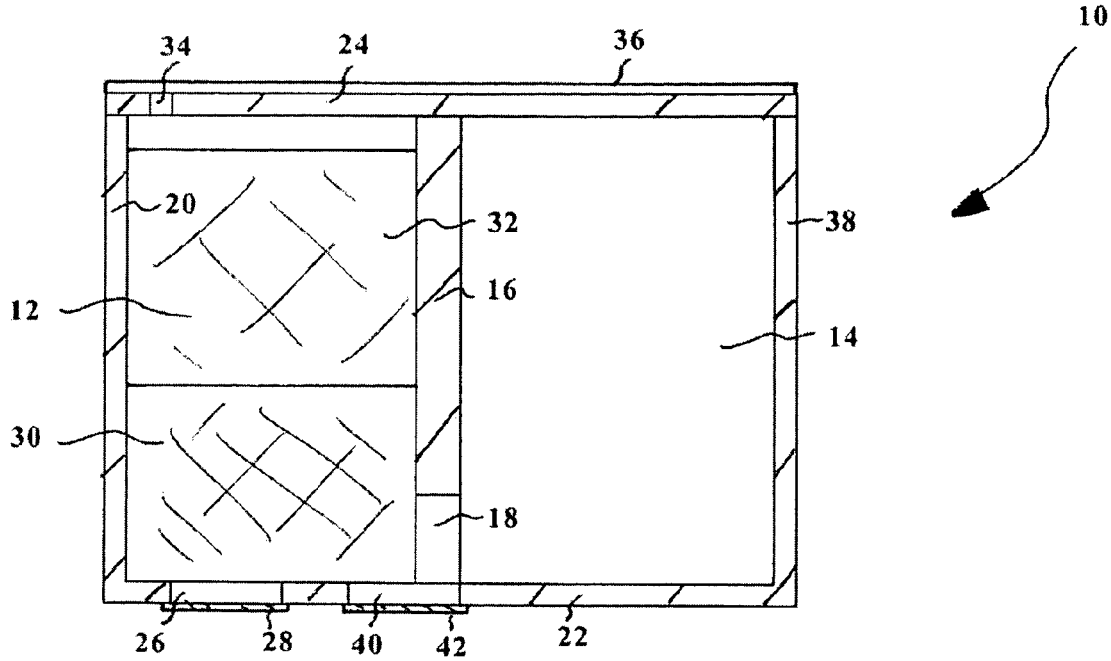
FIG. 1 is profile, cross-sectional view of a first exemplary ink tank in accordance with the present invention.

Referencing FIG. 1, a first exemplary ink tank 10 includes a backpressure chamber 12 and a free ink chamber 14 partially separated from one another by an internal wall 16. An orifice 18 through the internal wall 16 provides direct communication between the chambers 12, 14. Right and left side walls (not shown) are connected to one another by way of a front wall 20, a floor 22, a lid 24, and the internal wall 16, which collectively generally define the backpressure chamber 12. An outlet opening 26 is included in the floor 22 that provides access to the interior of the backpressure chamber 12. The opening 26 is sealed using a film 28 (or gasket (not shown)) to be removed by a consumer prior to use of the ink tank 10. The opening 26, subsequent to film 28 removal, is adapted to accommodate at least partial throughput of a snout of an ink receptacle (not shown) to facilitate transfer of liquid ink from the backpressure chamber to a plurality of nozzles of printhead (not shown).

Two backpressure mediums 30, 32 occupy the interior of the backpressure chamber 12. The first backpressure medium 30 occupies a lower portion, while the second backpressure medium 32 occupies the top portion. Each backpressure medium 30, 32 includes numerous pores that allow liquid ink and gases to travel through the medium, however, the liquid flow is retarded from gravitationally egressing through the medium by capillary action. In this exemplary embodiment, the first backpressure medium 30 is typically a higher backpressure and higher density felt, foam, or fiber while the second backpressure medium 32 is a lower backpressure and lower density felt, foam, or fiber. The pore size of the second backpressure medium 32 retards the flow of liquid ink to a lesser extent than that of the first backpressure medium 30.

A vent 34 within the lid 24 is in communication with the second backpressure medium 32 and the external environment. In this exemplary embodiment, the vent 34 includes a serpentine trench (not shown) in communication with the vent opening through the lid 24 that cooperates with an adhesive label 36 to provide a serpentine conduit (not shown), with a portion of this adhesive label 36 being removed prior to installation in order to expose the serpentine conduit to the external environment. Thus, as liquid ink flows through the second backpressure medium 32 to replace the ink withdrawn from the first backpressure medium 30 via the opening 26, gases flow into the backpressure chamber 12 through the vent 34 to replace the volume within the backpressure medium 32 no longer occupied by liquid ink. It is also within the scope of the invention to utilize a vent seal or vent tape (not shown), separate from the adhesive label 36, that a user removes prior to installation of the tank 10 that overlies the exposed end of the serpentine conduit.

The free ink chamber 14 is also defined by right and left side walls (not shown), the floor 22, the lid 24, and a rear wall 38. In this exemplary embodiment, the free ink chamber 14 is adapted to be occupied by liquid ink, with no backpressure medium. The floor 22 includes an orifice 40 that is sealed using a polymer film 42. The application of the film 42 to the underside of the floor 22 does not hinder the functionality of the orifice 18 through the internal wall 16. Therefore, liquid ink enters the backpressure chamber 12 when the level of liquid ink within the backpressure chamber 12 drops sufficiently to allow gas from the backpressure chamber 12 to enter the free ink chamber 14. As will be discussed in more detail hereafter, the orifices 18, 40 may be formed using a plurality of different techniques.

Fabrication of the exemplary ink tank 10 includes injection molding the floor 22, side walls, front and rear walls 20, 38, and interior wall 16 as a single piece structure. When molded in this exemplary process, the interior wall 16 completely separates the backpressure chamber 12 from the free ink chamber 14. After the single piece structure is molded, it is removed from the mold and processed by a cutting tool (not shown) that creates one opening 40 or both of the openings 26, 40 within the floor, given that one of the openings 26 may be formed during the molding process. After forming the opening 40 through the floor 22, the cutting tool continues vertically upward to remove a portion of the internal wall 16, thereby forming the orifice 18.

Alternatively, the exemplary ink tank 10 may be fabricated by injection molding the floor 22, side walls, front and rear walls 20, 38, and interior wall 16 as a single piece structure, along with molding both of the openings 26, 40 within the floor and the orifice 18 through the interior wall 16. Creating the orifice 18 in this manner does not require utilization of molding slides that might otherwise complicate the molding process.

Regardless of the fabrication approach utilized, the first polymer film 28 and the second polymer film 42 are laid over the openings 28, 40 in the floor 22 to create a fluidic seal across the floor. An adhesive process is performed to mount the first film 28 to the outlet opening 26, whereas a heat staking operation is performed to attach the second film 42 to the second opening 40, thereby inhibiting fluid communication through the outlet orifice 26 and the opening 40. It is to be understood that the first film 28 is mounted to enable eventual removal, whereas the second film is mounted to inhibit removal. Thereafter, each backpressure medium 30, 32 is inserted into the backpressure chamber 12, followed by mounting the lid 24 to complete the formation of the chambers 12, 14.

It is to be understood that ink may be added at various stages during the exemplary fabrication process such as, without limitation, after the introduction of the backpressure media 30, 32, or after mounting the lid 24. Moreover, the ink may be introduced after mounting of the lid 24 by introducing ink through a fill port (not shown) formed through the lid. Those of ordinary skill are familiar with conventional fill ports and the devices utilized to plug the fill ports, such as fill balls, subsequent to an ink fill operation. Therefore, the exemplary fabrication sequence is amendable to many obvious variations incorporating the aforementioned features and process steps.

Figure 2:
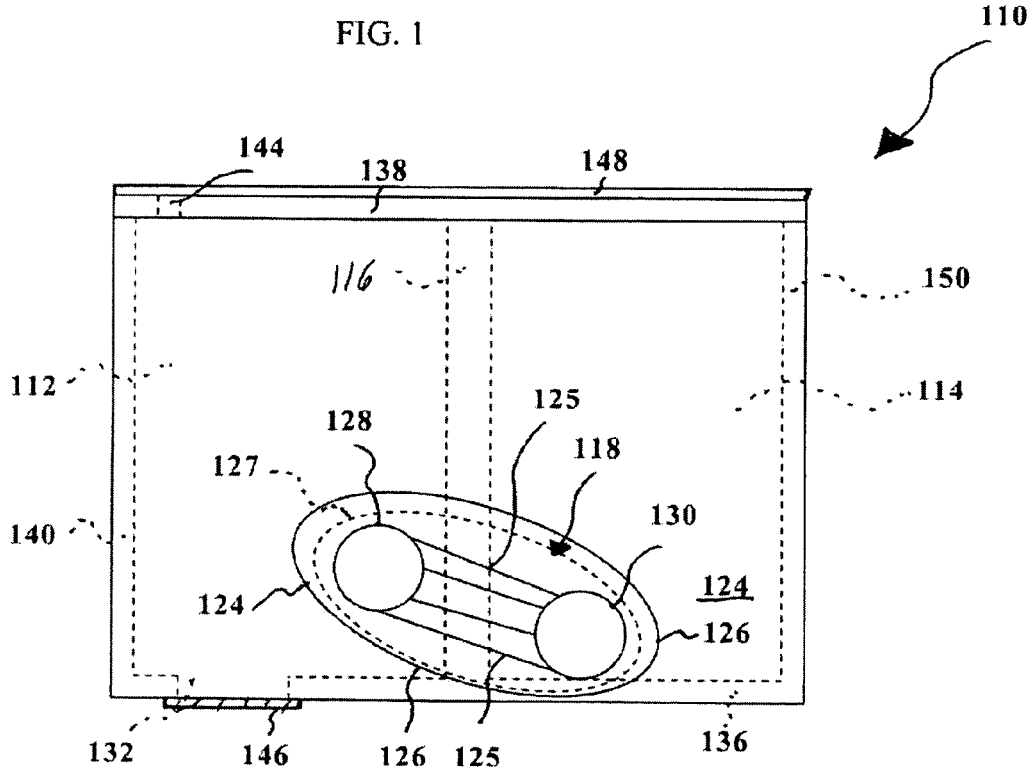
FIG. 2 is a profile view of a second exemplary ink tank in accordance with the present invention.
Figure 3:
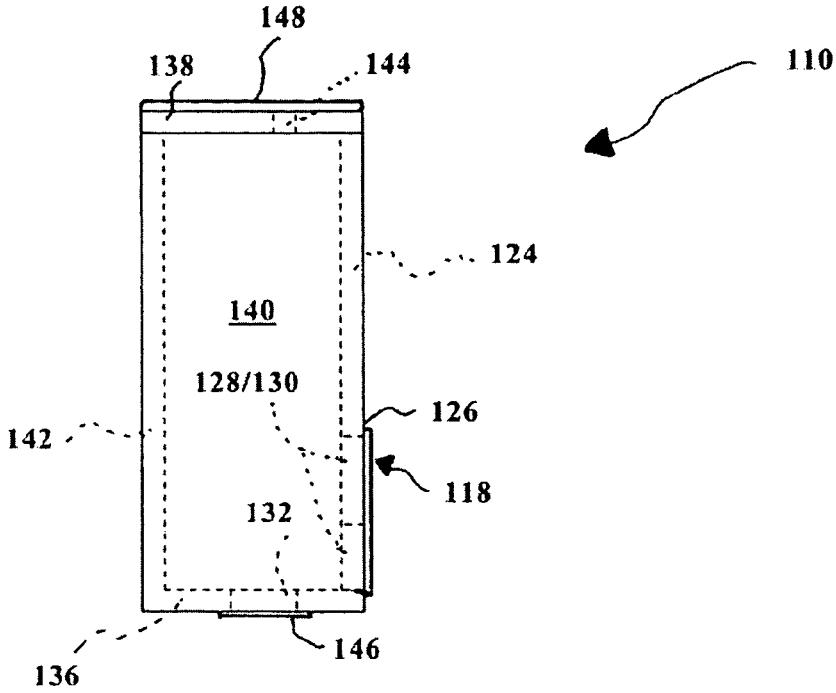
FIG. 3 is a frontal view of the second exemplary ink tank of FIG. 2.

Referencing FIGS. 2 and 3, a second exemplary ink tank 110 includes a backpressure chamber 112 and a free ink chamber 114 separated from one another by an internal wall 116. An external conduit assembly 118 connects the chambers 112, 114 to one another for the transfer of gases into the free ink chamber 114 and the transfer of ink into the backpressure chamber 112. The external conduit assembly 118 is bounded in part by an exterior wall 124 of the tank 110, which may optionally have grooves, pathways or other such depressions 125 molded or otherwise formed therein, as well as by a polymer film 126 sealed substantially about its periphery to the exterior wall 124 that encompasses two inlet/outlet orifices 128, 130 extending through the exterior wall 124 and further encompassing the depressions 125 extending between the inlet/outlet orifices 128, 130. The first inlet/outlet orifice 128 provides access to the interior of the backpressure chamber 112, while the second inlet/outlet orifice 130 provides access to the interior of the free ink chamber 114. Because the continuous seal 127 between the polymer film 126 and the exterior wall 124 surrounds both inlet/outlet orifices 128, 130, fluid communication is provided between the inlet/outlet orifices 128, 130. The optional depressions 125 may also facilitate or improve fluid communication between the inlet/outlet orifices 128, 130 after the film 126 is sealed over the exterior wall 124. Such depressions 125 could possibly allow the film 126 to be sealed across the exterior wall's flat surface, thereby allowing for lesser precision in the sealing operation; or the depressions could be used in addition to the surrounding seal 127.

The backpressure chamber 112 acts as a holding area for ink prior to the ink egressing through an outlet orifice 132. Four vertical walls 116, 124, 140, 142, a floor 136, and a top lid 138 define the interior region of the backpressure chamber 112. The interior region is majority occupied by one or more backpressure mediums (not shown) that are in communication with a vent 144 formed through the top lid 138. A second polymer film 146 is mounted to the floor 136 and circumscribes the outlet orifice 132 to inhibit ink from egressing through the outlet orifice. Finally, a label 148 is adhesively mounted over the lid 138 and cooperates with the vent 144 to provide a serpentine conduit (not shown) between backpressure chamber 112 and an external environment to inhibit ink from egressing from the backpressure chamber 112. As with the first exemplary embodiment, a portion of the label 148 may be removed to expose one end of the serpentine conduit, or a separate a vent seal or vent tape (not shown) may be removed to expose one end of the serpentine conduit.

The free ink chamber 114 is adapted to house liquid ink prior to the ink being introduced into the backpressure chamber 112. In this exemplary embodiment, the interior of the free ink chamber 112 is defined by four vertical walls 116, 124, 142, 150, the floor 136, and the top lid 138. Ink travels from the free ink chamber 114 and through the conduit assembly 118 into the backpressure chamber 112 when the level of ink within the backpressure chamber 112 drops sufficiently to allow gas from the backpressure chamber 112 to enter the conduit assembly 118 and travel into the free ink chamber 114.

Fabrication of the second exemplary ink tank 110 includes injection molding the floor 136, vertical walls 116, 124, 140, 142, 150 as a single piece structure. Each of the orifices 128, 130, 132 through, and depressions in, the exterior wall 124 are molded or are later cut or otherwise formed in the wall 124. Thereafter, the first polymer film 126 is laid over the orifices 128, 130 (and the optional depressions 125 extending therebetween), while the second polymer film 146 is laid over the outlet orifice 132. In the exemplary embodiment, a heat staking operation is performed to attach the film 126 to the exterior wall 124 along a seal 127 circumscribing collectively the orifices 128, 130 to form the conduit 118. The other film 146 is attached to the underside of the floor 136 using an adhesive and the film circumscribes the outlet orifice 132, thereby inhibiting fluid communication through the outlet orifice 132. A backpressure medium (not shown) is inserted into the backpressure chamber 112, followed by mounting the lid 138 to the exposed tops of the walls 116, 124, 140, 142, 150 to complete the formation of the chambers 112, 114. Ink is also introduced in to chambers 112, 114, followed by mounting the label 148 to the lid 138.

Figure 4:
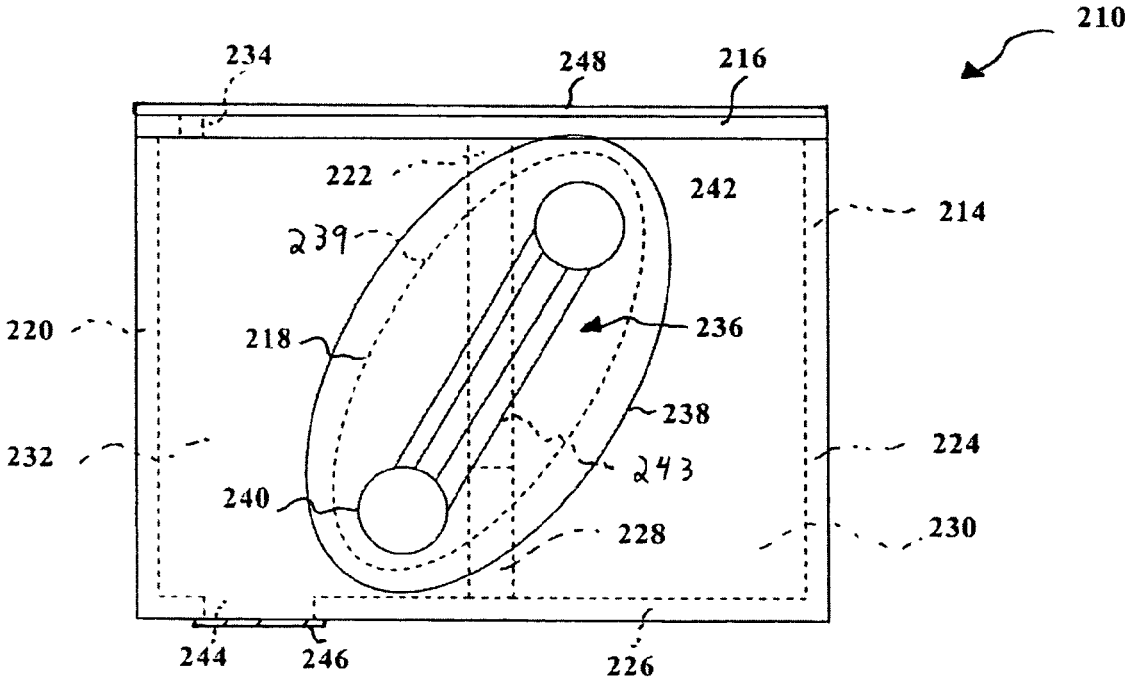
FIG. 4 is a profile view of a third exemplary ink tank in accordance with the present invention.
Figure 5:
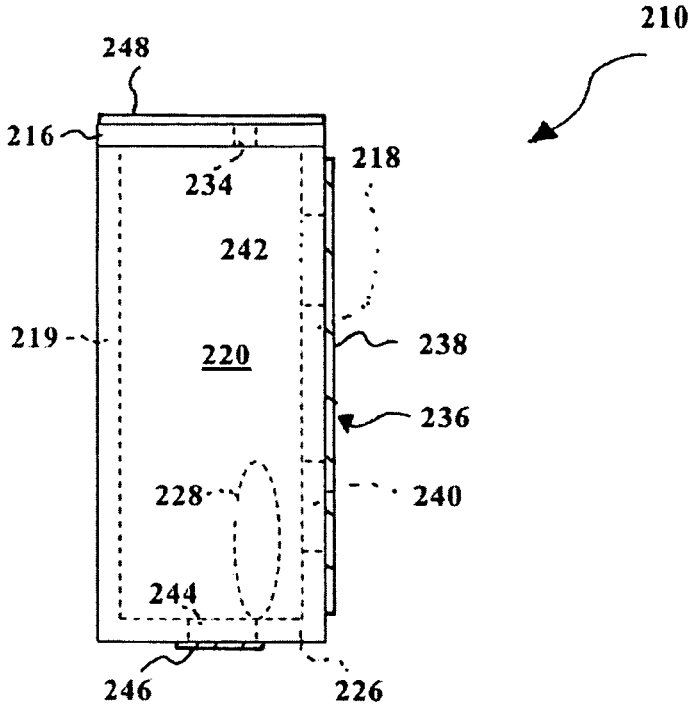
FIG. 5 is a frontal view of the third exemplary ink tank of FIG. 4.

Referencing FIGS. 4 and 5, a third exemplary ink tank 210 includes a plastic unitary body 214 and a top lid 216. The unitary body 214 includes side walls 218, 219, a front wall 220, an internal wall 222, a rear wall 224, and a floor 226. An orifice 228 through the internal wall 222 allows communication between a free ink chamber 230 and a backpressure chamber 232. The top lid 216 is mounted to the exposed end of the unitary body 214 and includes a vent 234 allowing communication between an external environment and the interior of the backpressure chamber 232.

An external conduit assembly 236 also provides communication between the respective chambers 230, 232. The conduit assembly 236 is defined by the cooperation of a film 238 mounted substantially about its periphery to the exterior of the side wall 218, where the seal 239 between the wall 218 and the film 238 surrounds two inlet/outlet orifices 240, 242 formed through the side wall 218. One of the inlet/outlet orifices 240 leads into the interior of the backpressure chamber 232, while the other inlet/outlet orifice 242 leads into the interior of the free ink chamber 230. Depressions 243 within the side wall 218 run between the orifices 240, 242 and are operative to provide fluid communication between the inlet/outlet orifices 240, 242.

Even when an outlet orifice 244 of the backpressure chamber 232 is sealed by a second film 246, and the vent 234 is sealed by a label 248 or other sealing material, the ink and gases may be exchanged between the chambers 230, 232 via the external conduit assembly 236 to accommodate for pressure changes exerted upon the fluids within the chambers 230, 232. In a preferred installation and subsequent operation, a portion of the label 248 and the entire film 246 are removed, and ink flows from the backpressure chamber 232 through the orifice 244 and gases flow into the backpressure chamber 232 by way of the vent 234 in order to replace the volume previously occupied by liquid ink. Preferably, the backpressure chamber 232 houses a saturated medium, while the free ink chamber houses ink. Eventually, the level of ink within the backpressure chamber 232 drops and allows gas within the backpressure chamber 232 to be exposed to the inlet/outlet orifice 240. At this point, a transfer cycle is created similar to that between the vent 234 and outlet orifice 244, where gas from the backpressure chamber 232 enters the free ink chamber 230 by way of the conduit assembly 236, and ink travels from the free ink chamber 230 into the backpressure chamber 232 in an amount roughly equal to the volume of gas entering the free ink chamber 230 from the backpressure chamber 232. In this manner, gas and ink can freely travel into their respective chambers without the other fluid hindering the progress as the gas can travel via the conduit 236 and the liquid ink can travel via the opening 228. This cycle of gas displacing the liquid ink in the free ink chamber 230 continues until the level of ink within the backpressure chamber 232 is below that of the openings 228. Gas may travel into the free ink chamber using a combination of the opening 228 and the conduit assembly 236. Continued ejection of the ink from the backpressure chamber 232 via the outlet orifice 244 continues until both of the chambers 230, 232 are essentially empty of ink.

Fabrication of this third exemplary ink tank 210 includes injection molding the floor 226, vertical walls 218, 219, 220, 222, 224, as a single piece structure in which each of the orifices 228, 240, 242, 244 has already been formed. Thereafter, the first polymer film 238 is heat staked to form an outline seal surrounding the inlet/outlet orifices 240, 242, while the second polymer film 246 is adhesively mounted over the outlet orifice 244.

An applicable backpressure medium (not shown) is inserted into the backpressure chamber 232, followed by mounting the lid 216 to the exposed walls of the single piece structure 214, thereby completing the formation of the chambers 230, 232. Ink is then introduced into the chambers by way of an ink fill port (not shown), followed by mounting the label 248 to the lid 216 to seal the vent 234 and render the tank 210 ready for shipment.

Figure 6:
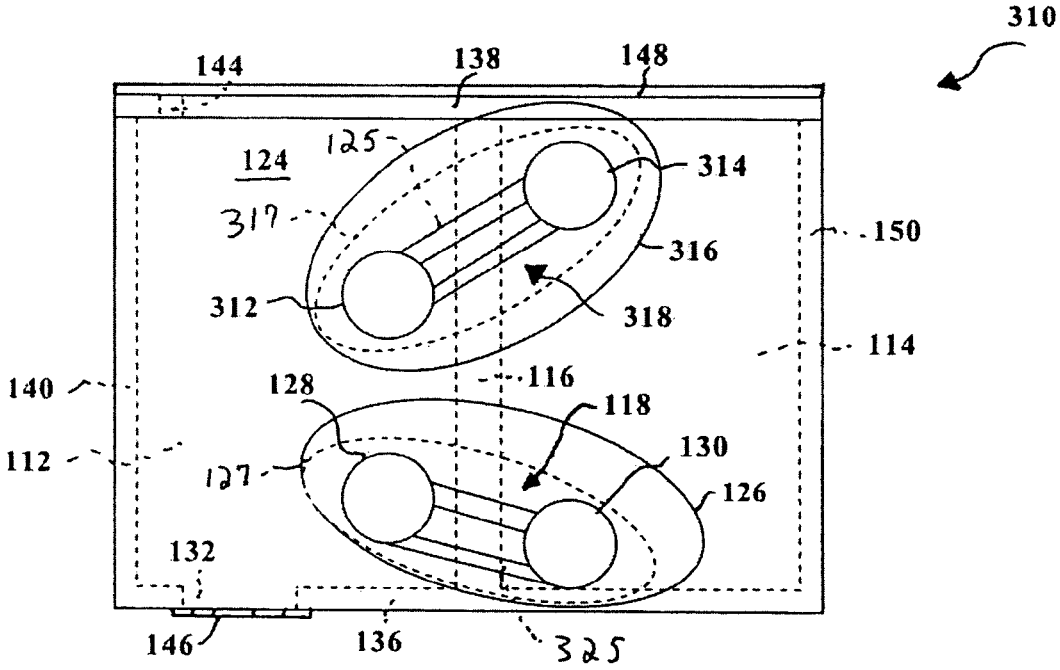
FIG. 6 is a profile view of a fourth exemplary ink tank in accordance with the present invention.

Referencing FIG. 6, a fourth exemplary ink tank 310 includes essentially the same structure as the second exemplary ink tank 110, but also includes two additional inlet/outlet orifices 312, 314 covered by an additional polymer film 316 which is heat staked to the exterior wall 124 forming a seal line 317 surrounding the inlet/outlet orifices 312, 314. The orifices 312, 314, the film 316, and the exterior wall 124 of the tank 310 cooperate to define a second conduit 318 to provide two conduits 118, 318 for communication between the free ink chamber 114 and the backpressure chamber 112. Each conduit 118, 318 includes depressions 125, 325 directing fluids (i.e., ink, gas, etc.) between the orifices 128, 130, 312, 314. In this manner, as the level of ink drops within the backpressure chamber 112 below the inlet/output orifice 312, gases from the backpressure chamber 112 travel through the second conduit 318 in an uninterrupted path, thereby displacing ink with the free ink chamber 114 traveling into the backpressure chamber via the first conduit 118. In this way, ink and gases may flow through the respective conduits 118, 318 in a countercurrent and uninterrupted manner.

Figure 7:
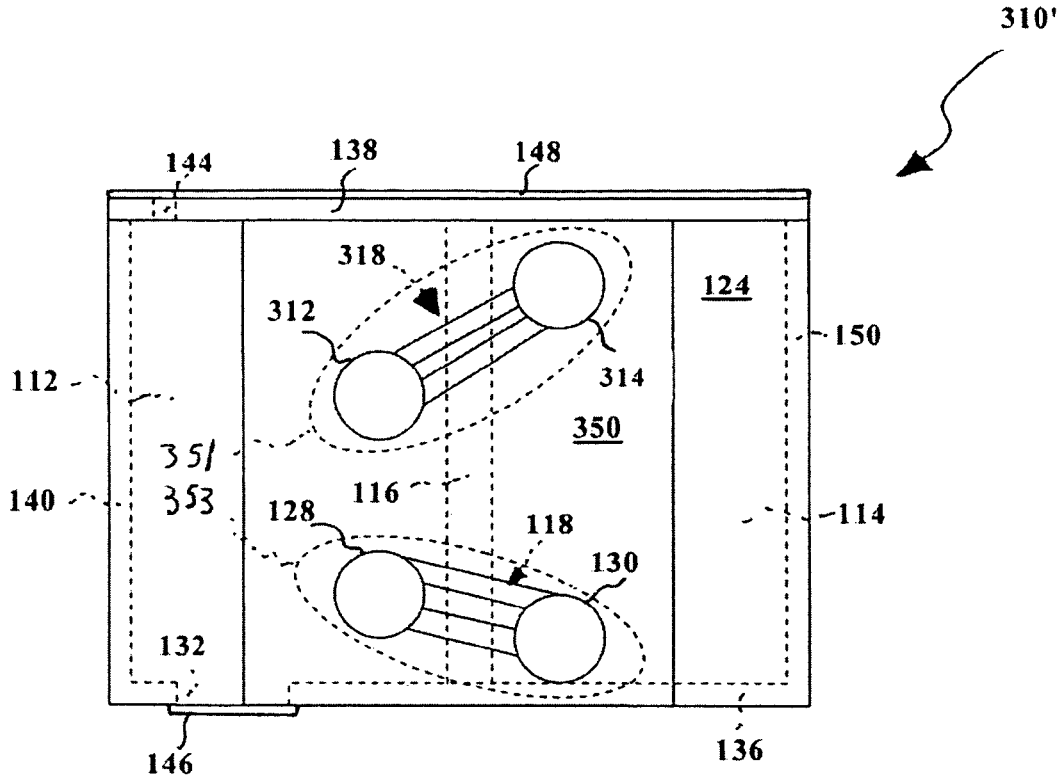
FIG. 7 is a profile view of a fourth alternate exemplary ink tank in accordance with the present invention.

Fabrication of the fourth exemplary ink tank 310 is consistent with those fabrication steps discussed above for the second exemplary ink tank 110, in addition to the formation of the orifices 312, 314. The orifices 312, 314 are molded into the exterior wall 124 of the floor 136 and walls 116, 124, 140, 150 of the tank 310. Application of the film 316 to the exterior wall 124 is consistent with the processes discussed in the second exemplary embodiment for attaching the first film 126 to the exterior wall 124 to maintain a fluidic seal between the film and wall. In this regard, separate pieces of film may be used to fabricate the first and second conduits 118, 318, or a single piece of film 350 may be utilized to form the separate conduits 118, 318 to produce a fourth alternate exemplary ink tank 310' (see FIG. 7). As shown in FIG. 7, the single piece film 350 is sealed to the exterior wall about a seal line 351 that surrounds orifices 312 and 314, and a second seal line 353 that separately surrounds orifices 128 and 130, thus respectively providing conduits 318' and 118'. Those of ordinary skill will readily understand how these fourth exemplary embodiments operate and how these fourth exemplary embodiments may be fabricated following the teachings recited above for the alternate exemplary embodiments of the instant invention.

Figure 8:
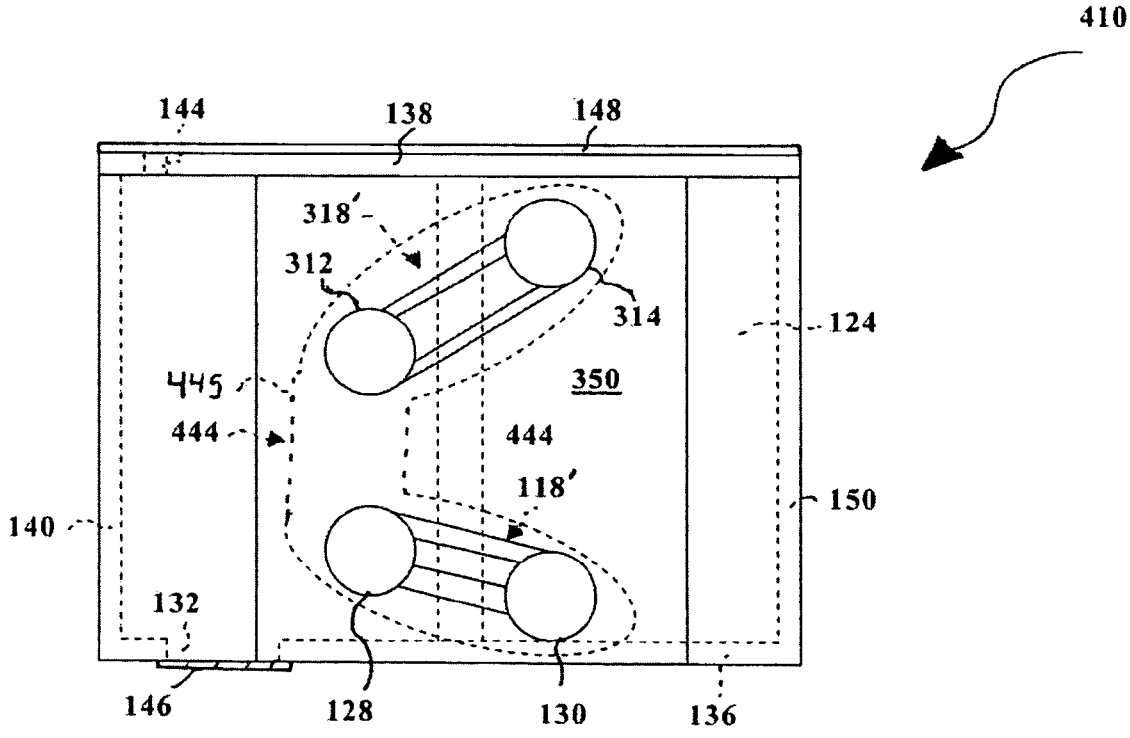
FIG. 8 is a profile view of a fifth exemplary ink tank in accordance with the present invention.

Referencing FIG. 8, a fifth exemplary ink tank 410 includes essentially the same structure as the fourth alternate exemplary ink tank 310', but includes a single seal line 445 surrounding the orifices 128, 130, 312, 314. A bridge 444 is formed within the seal line 445 that allows direct communication between the conduits 118', 318'. In this manner, air bubbles caught within the first conduit 118' can travel through the bridge 444 and into the second conduit 318'.

Fabrication of the fifth exemplary ink tank 410 is consistent with those fabrication steps discussed above for the second exemplary ink tank 110 and the fourth alternate exemplary ink tank 310'. Instead of sealing the single film 350 to the exterior wall 124 to define separate conduits 118', 318', the heat seal line 445 surrounds the four orifices 128, 130, 312, 314 and preserves the conduits, while allowing direct communication between the conduits by way of the bridge 444.

Figure 9:
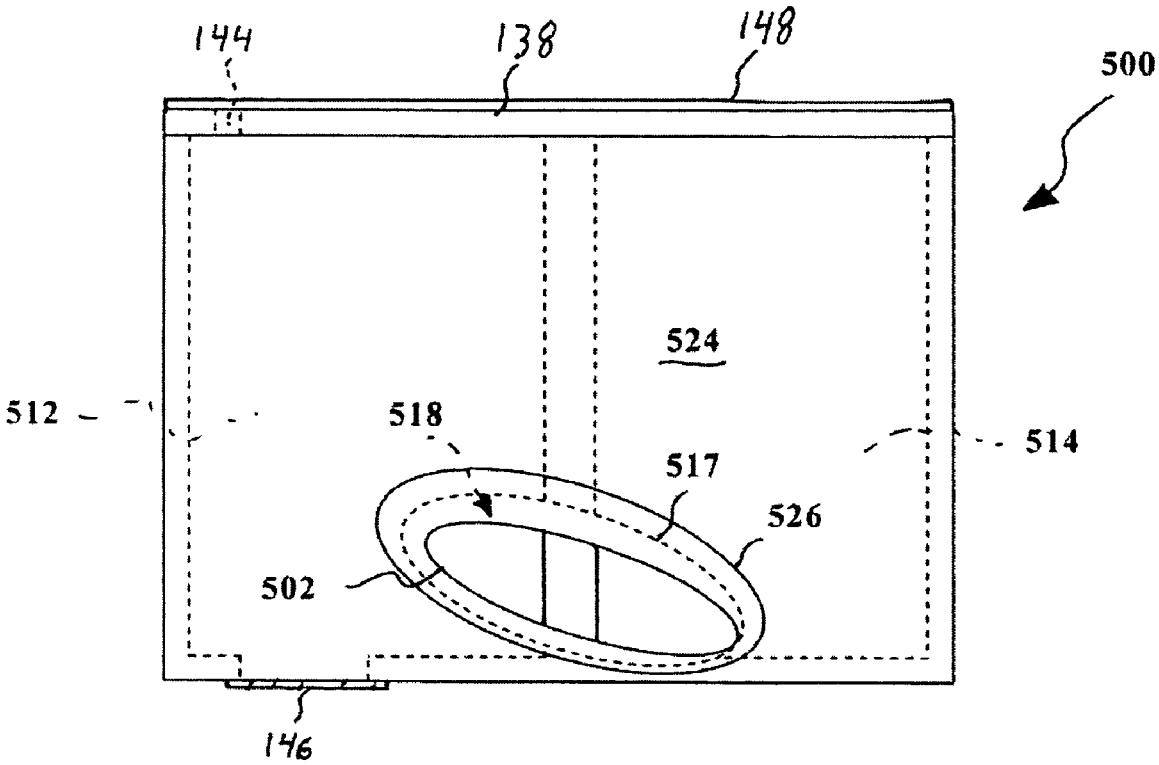
FIG. 9 is a profile view of a sixth exemplary ink tank in accordance with the present invention.

Referencing FIG. 9, a sixth exemplary ink tank 500 includes a single orifice 502 that bridges the free ink chamber 514 and backpressure chamber 512. A film 526 is mounted over the orifice 502 and to an external wall 524 of the tank 500 to create a conduit 518, defined within a seal line 517, that effectively bridges the chambers 512, 514. Exemplary procedures for mounting the film 526 to the external wall 524 include, without limitation, heat staking and laser welding. The exemplary single orifice 502 may be used in place of the multiple orifices discussed in the first through fifth exemplary embodiments that cooperate to provide entry and exit openings for any of the exemplary conduits discussed herein.

In accordance with the foregoing exemplary embodiments, the films utilized to create the conduits between the free ink chamber and the backpressure chamber include, without limitation, polypropylene films, polyethylene films, copolymer films, metallic films, and composite films (such as polymer films interposing metallic films). In addition, the exemplary films may be mounted to the ink tanks using the exemplary heat staking process, as well as other sealing and bonding processes such as, without limitation, laser welding, ultrasonic welding, vibrational welding, and adhesive. Moreover, the term "film" as used herein is not restricted to the literal meaning. By way of example, and not limitation, the term "film" as used herein also encompasses solid plate material and solid preformed bubble castings or moldings that may be mounted to the exemplary tanks to create the exemplary conduits between chambers.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A method of forming a conduit providing fluid communication between respective reservoirs of an ink tank, the method comprising the steps of:

forming a first orifice extending through a first external wall portion of an ink tank defining part of a first ink reservoir of the ink tank;

forming a second orifice extending through a second external wall portion of the ink tank defining part of a second ink reservoir of the ink tank; and attaching a substrate over the first and second external wall portions at least about a first continuous seal line surrounding both the first and second orifices to define an external conduit allowing direct bidirectional communication between the first ink reservoir and the second ink reservoir, wherein the first orifice is adjacent to a first backpressure medium occupying at least a portion of an internal volume of the first ink reservoir and the second orifice is in direct communication with free ink occupying at least a portion of an internal volume of the second ink reservoir;

and wherein further the substrate comprises a polymer film; and the film is laminated to an exterior wall of the first ink reservoir and to an exterior wall of the second ink reservoir.

2. The method of claim 1, further comprising the step of providing at least one depression in the first and second external wall portions extending between the first and second orifices.

3. The method of claim 1, wherein the step of attaching the substrate to the first external wall portion and to the second external wall portion of the ink tank includes at least one of heat staking, laser welding, ultrasonic welding, vibrational welding, and adhesive mounting a film to the first external wall portion and to the second external wall portion of the ink tank.

* * * * *